US011148866B2

(12) United States Patent
Kaminski

(10) Patent No.: US 11,148,866 B2
(45) Date of Patent: Oct. 19, 2021

(54) AIRBAG WITH A HAMMOCK

(71) Applicant: Michael G Kaminski, San Jose, CA (US)

(72) Inventor: Michael G Kaminski, San Jose, CA (US)

( * ) Notice: Subject to any disclaimer, the term of this patent is extended or adjusted under 35 U.S.C. 154(b) by 0 days.

(21) Appl. No.: 17/105,629

(22) Filed: Nov. 26, 2020

(65) Prior Publication Data

US 2021/0078786 A1 Mar. 18, 2021

Related U.S. Application Data

(60) Provisional application No. 62/940,594, filed on Nov. 26, 2019.

(51) Int. Cl.
*B65D 81/05* (2006.01)
*B65D 81/07* (2006.01)

(52) U.S. Cl.
CPC ..... *B65D 81/052* (2013.01); *B65D 81/07* (2013.01)

(58) Field of Classification Search
CPC ..... B65D 81/075; B65D 81/07; B65D 81/03; B65D 81/052; B65D 81/05
USPC ..... 206/522, 583
See application file for complete search history.

(56) References Cited

U.S. PATENT DOCUMENTS

| | | | | |
|---|---|---|---|---|
| 7,631,762 | B2 * | 12/2009 | Liao | B65D 81/052 206/522 |
| 8,770,840 | B2 * | 7/2014 | Liao | B31D 5/0073 383/3 |
| 8,973,756 | B2 * | 3/2015 | Liao | B65D 81/022 206/522 |
| 9,027,756 | B2 * | 5/2015 | Yoshifusa | B65D 81/058 206/522 |
| 2005/0011807 | A1 * | 1/2005 | Dennison | B65D 5/5028 206/583 |
| 2015/0259121 | A1 * | 9/2015 | Liao | B65D 81/03 206/521 |
| 2017/0217660 | A1 * | 8/2017 | Zhang | A45C 13/021 |
| 2020/0270049 | A1 * | 8/2020 | Liao | B65D 81/052 |

* cited by examiner

*Primary Examiner* — Steven A. Reynolds
(74) *Attorney, Agent, or Firm* — Barry Choobin; Patent 360

(57) ABSTRACT

Disclosed is an airbag having an upstanding wall defining an inner volume of a bag. The upstanding wall having an upper perimeter defining the opening of the bag. A web having a body and a perimeter around the body. The perimeter of the web bonded with the upper perimeter of the upstanding wall, wherein the body can be received into the inner volume of the bag forming an inner pouch, wherein the depth of the inner pouch inside the bag is less than the depth of the inner volume of the bag.

9 Claims, 4 Drawing Sheets

AIRBAG WITH A HAMMOCK

CROSS-REFERENCE TO RELATED APPLICATIONS

This application claims priority to a U.S. provisional patent application Ser. No. 62/940,594 filed Nov. 26, 2019, which is incorporated herein by reference in its entirety.

FIELD OF INVENTION

The present invention relates to packaging airbags, and more particularly, the present invention relates to a packaging airbag with an inner float pouch.

BACKGROUND

The packaging is a means to protect an article from contamination, dirt, and damage. The packaging is of utmost significance in the manufacture, sale, and transport of articles. The primary purpose of the packaging is to protect an article from the environment. For example, packaging can protect an article from dust, water, etc. Also, the packaging has a primary function to protect an article from an external shock or a bump. This function of packaging is of importance in the transportation of fragile articles which are very susceptible to damage during transportation. Good packaging can protect an article from damage due to shock or bumps both during transportation and the mishandling of the article.

Different kinds of packaging materials are commercially available, such as paper, plastic, and cardboard. Each packaging material has its uses and indications. The paper can be used to protect an article from dirt. The plastic can protect an article from both dirt and liquid. Cardboards, on the other hand, are sturdy and can provide limited protection against shocks. For enhanced protection against shocks, materials such as Styrofoam, foam, bubble packs, crumpled paper, or airbags, each being inserted inside a bag or container are popularly used.

Airbags are bags that have air as the cushioning material to protect an article surrounded by or contained in the airbag. The airbag can be made of polyethylene or other materials having comparable properties. The airbag is manufactured as a sheet having two overlapping plies. The two plies have air cavities which can be inflated. The airbag can be manufactured in the form of a container. For example, airbag containers are used to contain glass bottles for protection against bumps, shocks, vibration as well as thermal insulation. Such airbag containers have become quite popular for the transportation of wine bottles. At retail outlets, costly glass articles, such as wine bottles are packed in airbag containers for protection. Although airbags provide good cushioning, but the cushion is not enough for delicate articles, such as laptops and tablet computers. Particularly, the known designs of airbags do not provide enough protection for the edges that are more susceptible to damage by bumps. Thus, a need is appreciated for an improved airbag design that provides overall protection against bumps and shock.

Hereinafter the term tubes, channels, chambers, and columns are interchangeably used and refer to an inflatable prolong structure preferably made of flexible material.

SUMMARY OF THE INVENTION

The principal object of the present invention is therefore directed to an airbag for packaging.

It is another object of the present invention that an article can floatably received in the airbag.

It is an additional object of the present invention that the airbags provide enhanced protection at the edges.

In one aspect, disclosed is an airbag with an inner hammock that floats from the periphery of the bag. The airbag includes an upstanding wall defining an inner volume of a bag, the upstanding wall having an upper perimeter. The periphery of the flexible web can bond with the upper periphery of the upstanding wall forming the hammock or an inner pouch. The inner pouch can be received into the inner volume of the bag, such as the depth of the inner pouch is less than the depth of the inner volume of the bag. The upstanding wall comprises a series of inflatable tubes arranged side-by-side. Each inflatable tube of the series of inflatable tubes having an opening for receiving air under pressure, the opening configured with a one-way valve.

In one aspect, the upstanding wall includes the front wall and the rear wall and each of two opposite edges of the web can be coupled to the upper perimeter of the front wall and the rear wall.

In one aspect, the upstanding wall includes the front wall and the rear wall, and each of the two opposite edges of the web can be coupled to the inner sides of the front wall and the rear wall, respectively.

In one aspect, the depth of the inner pouch is at least 0.5 inches less than the depth of the inner volume of the bag.

In one aspect, the upstanding wall is of a cylindrical configuration having a circular upper perimeter. The periphery of the web can be bonded with the upper perimeter of the upstanding wall or inner sides of the upstanding wall of the bag.

These and other objects and advantages of the embodiments herein will become readily apparent from the following detailed description taken in conjunction with the accompanying drawings.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, the reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is to describe specific embodiments only and is not intended to be limiting of embodiments of the invention. As used herein, the singular forms "a", "an" and "the" are intended to include the plural forms as well, unless the context indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

Figure 1:
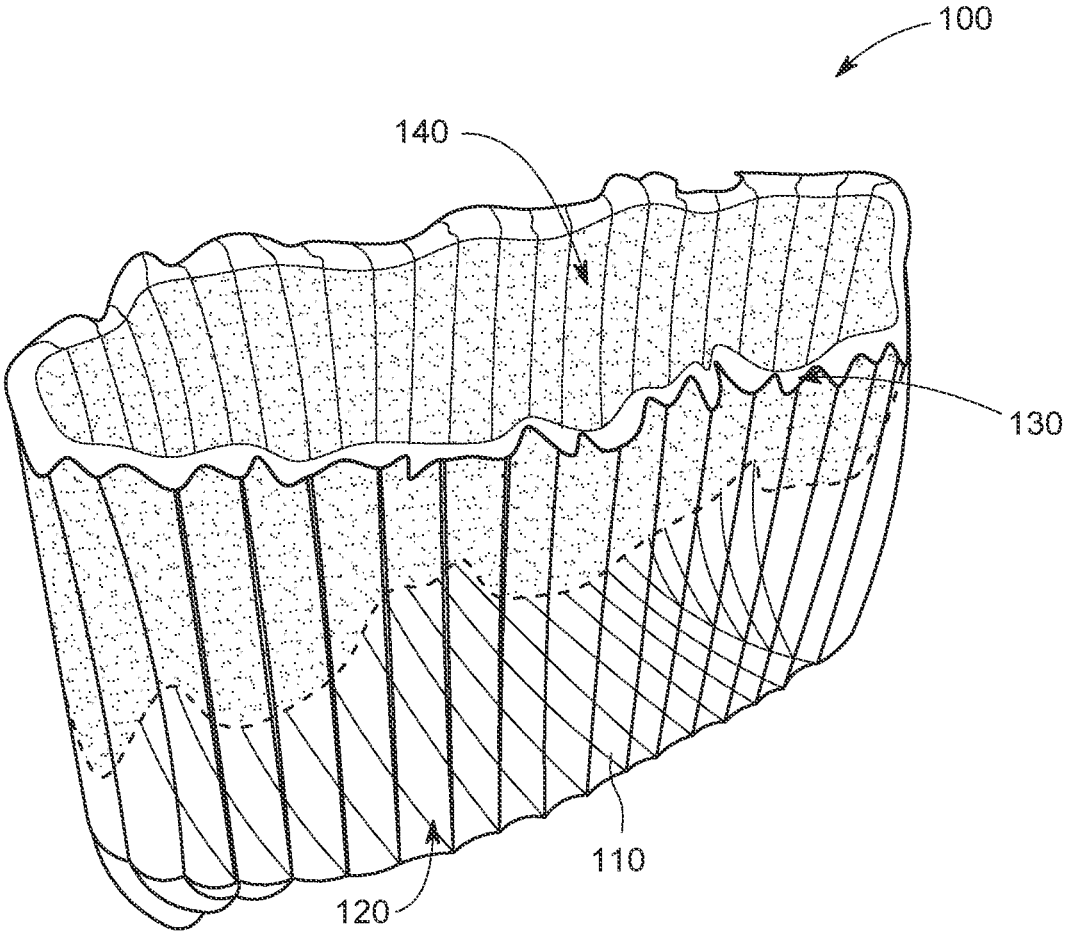
FIG. 1 is a perspective view of an airbag having an inner float pouch, according to an exemplary embodiment of the present invention.

Referring to FIG. 1 illustrating an exemplary embodiment of the disclosed airbag 100. The airbag 100 is having an upstanding wall 110 defining an inner volume of the bag. The upstanding wall includes a front wall and a rear wall bonded at their left and right edges. The bottom edges of each the front wall and the rear wall are coupled to a base. The upstanding front wall, rear wall, and base forming an elliptical-shaped bag. The top of the bag can be open to receive an article. The upper perimeter of the upstanding wall defines the opening of the bag. It is to be understood that FIG. 1 shows an elliptical bag, bags of other shapes are within the scope of the present invention. For example, the upstanding wall can be cylindrical with a round base. Such a cylindrical-shaped bag can be used for storing bottles. The rectangular-shaped bags can be used for storing tablet computers. The upstanding wall and the base, including includes a series of inflatable tubes 120 arranged side-by-side along the length of the bag.

The airbag also includes a web 140 of an elongate configuration. For example, the web can be rectangular made of a flexible material. In one case, both the bag and the web can be made of the same material. The web along its edges can be seen in FIG. 1 bonded to the upper perimeter 130 of the upstanding wall 110. The body of the web is received into an inner volume of the bag to form an inner pouch. The inner pouch suspends in the inner volume of the bag, such as the depth of the inner bag is less than the depth of the inner volume of the bag.

An article for storage can be received in the inner volume or cavity of the airbag. The article can be held at a distance above the base of the bag in the pouch. In one case, the depth of the valley is 0.5 inches less than the depth of the cavity of the bag. Perhaps the bag forms a U-shaped inner pouch that is suspended from the periphery of the outer bag, wherein the inner pouch floats with relative to the outer bag. The web may or may not include the inflatable tube. In one case, the web or the inner pouch can include a series of inflatable tubes that provided additional protection.

Figure 2:
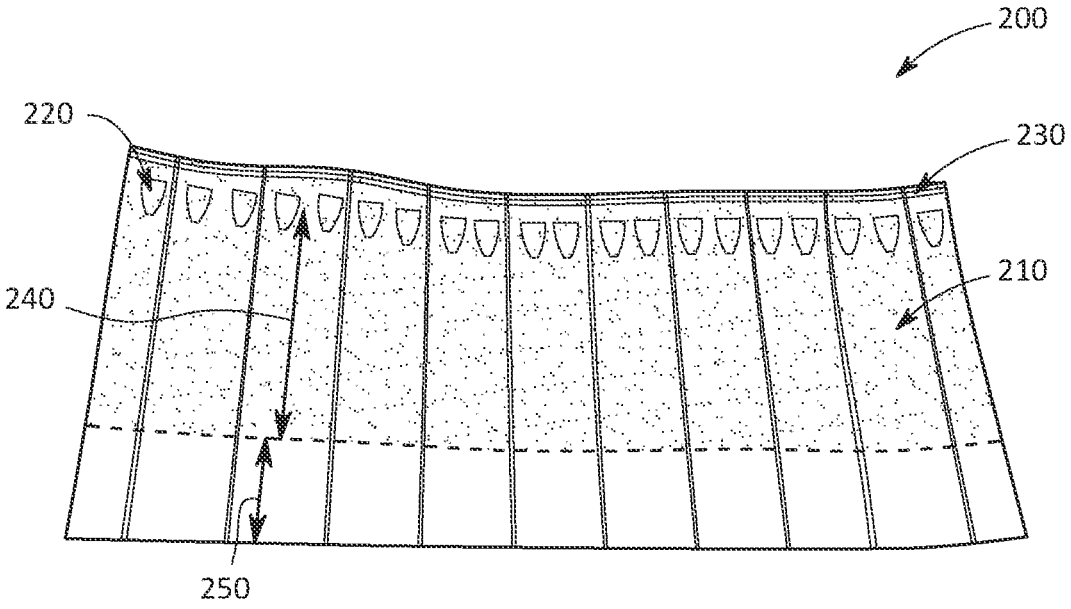
FIG. 2 is a front view of the airbag showing the inner pouch by shading, according to an exemplary embodiment of the present invention.

Referring to FIG. 2, which shows the disclosed bag 200 in a deflated configuration. The walls of the bag include a series of inflatable tubes 210 arranged side-by-side along the length of the bag. The series of inflatable tubes are arranged parallel to each other and perpendicular to the opening of the bag. However, the series of inflatable tubes can also be arranged parallel to the bag opening. Each tube includes an opening for receiving air under pressure for inflating the inflatable tubes. The openings can be configured with one-way valves 220 that allow the air to be filled in the inflatable tubes but prevents the leakage of the filled air from the opening. Each the front wall and the rear wall also include an appendage 230 that extends from the upper perimeter of the walls. A web can be bonded at its edges to the appendages or the upper perimeter of the front wall and the rear wall. The web forming an inner pouch of a depth shown by arrow 240. Arrow 250 shows the height from the inner pouch from the base.

Figure 3:
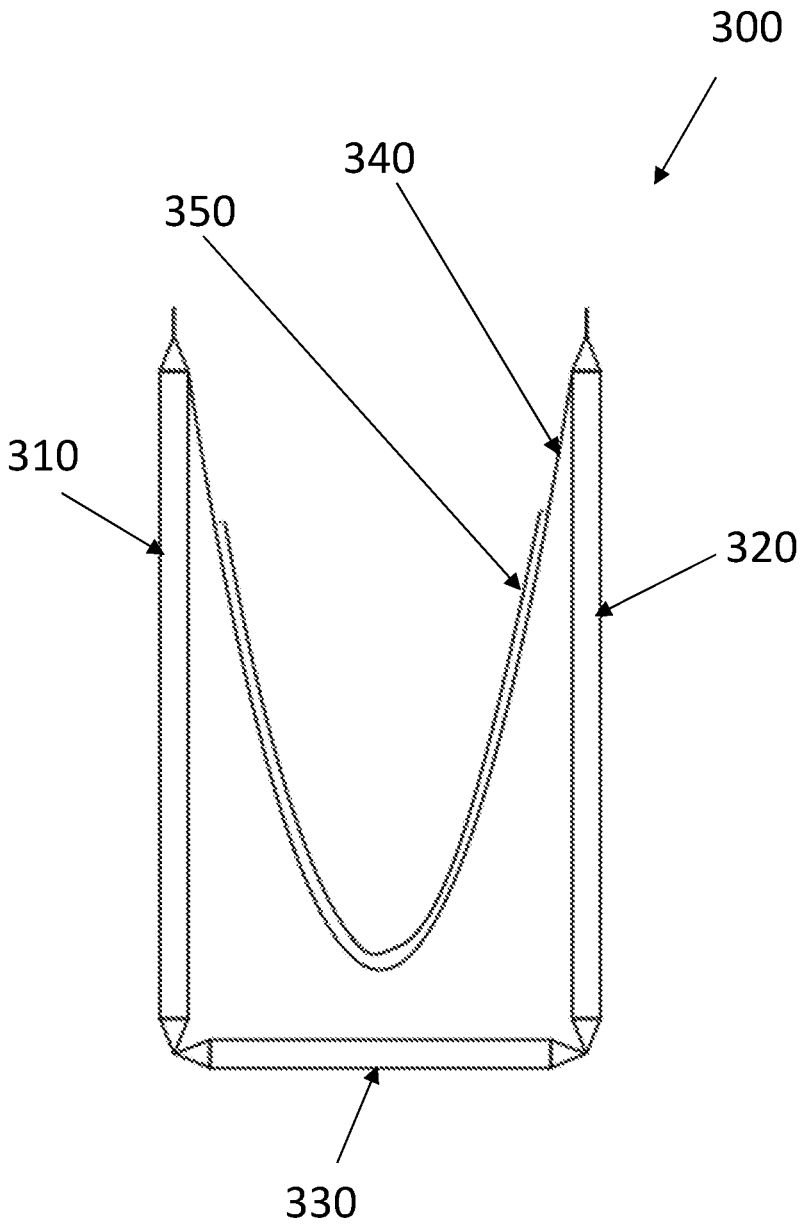
FIG. 3 is a sectional view of the airbag showing the front wall, the base, the rear wall, and the inner pouch, according to an exemplary embodiment of the present invention.

Referring to FIG. 3 which shows a side view of the disclosed bag. The bag 300 having a front wall 310, a rear wall 320, and a base 330. Each the front wall 310, rear wall 320, and base 330 having a series of inflatable tubes arranged side-by-side. A web forming an inner pouch 340 can be seen received into the inner volume of the bag. The bottom of the inner pouch can be seen at a height from the base 330. In one case, this height can be at least 0.5 inches. The inner pouch can be a planar flexible sheet. Alternatively, the inner pouch can also include a series of inflated tubes 350 providing additional protection. Also, can be seen in FIG. 3 is the inner pouch float respective to the front wall and the rear wall.

According to an alternate embodiment, disclosed is a bag that includes an upstanding wall defining an inner volume of the bag. The walls include a series of inflatable tubes arranged side-by-side. A web at its periphery can bond to the inner sides of the upstanding wall forming an inner pouch. An inner pouch bonded to the inner sides of the upstanding wall. The inner pouch is at a height from the base of the outer bag, such that the inner pouch floats relative to the outer bag. The inner pouch can receive an article for storage, wherein the article can be held at a height from the base, providing additional protection.

Figure 4:
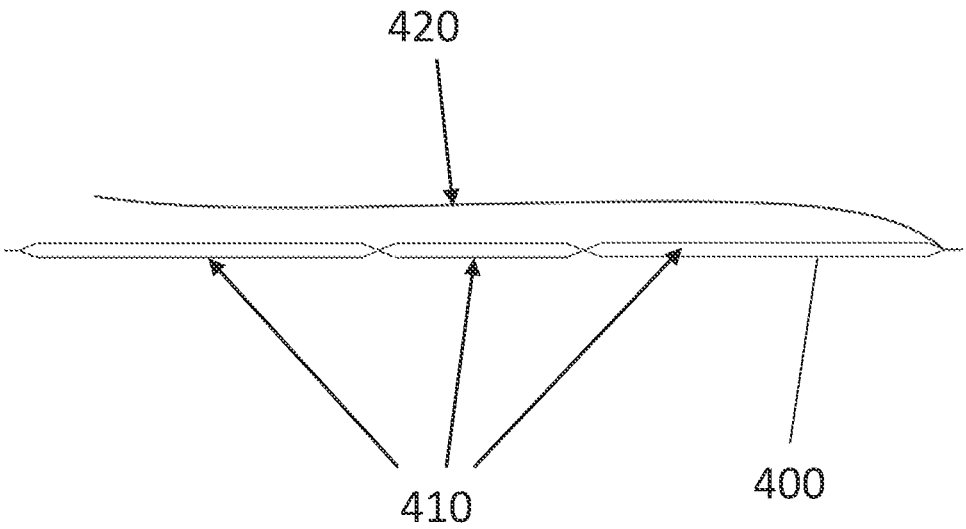
FIG. 4 shows a sheet that can be folded to form the disclosed bag of FIG. 1, according to an exemplary embodiment of the present invention.

In one embodiment, disclosed is a sheet that can be folded to form a bag. FIG. 4 shows a sheet 400 that includes a series of inflatable tubes 410 arranged side-by-side. Each tube has an opening that is configured with a one-way valve. A web 420 having at least one edge that is coupled to an edge of the sheet. The sheet 400 can be folded and bonded at opposite side edges to form a front wall, rear wall, and a base of the bag. The web can also be bonded with the upper perimeter of the bag to form an inner pouch which can contain the articles for storage.

In one implementation, disclosed is a bag for protecting corners of articles, such as a frame or TV. The bag includes an elongated web and an inflatable liner. Each web and the inflatable liner having a front edge, a rear edge, a left edge, and a right edge. The web is at least 1 inch less than the length of the inflatable liner, wherein the front edges and the rear edges of the web and the inflatable liner can be bonded. The inflatable line and the web can be folded with front edges facing the rear edges. Either the right side or the left side of the web can be bonded, while the two sides of the web are open. The bag can be mounted on the corner of an object through the two open sides.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An airbag comprises:

an upstanding wall and a base defining an inner volume of an airbag, the upstanding wall and the base having a plurality of inflatable tubes arranged side-by-side, the upstanding wall having a periphery; and a web having a periphery, the web at its periphery bonded to an inner side of the upstanding wall forming an inner pouch, wherein the inner pouch does not touch the base of the airbag, the periphery of the web does not couple with the periphery of the upstanding wall, and only the periphery of the web is bonded to the inner side of the upstanding wall.

2. The airbag according to claim 1, wherein the inner pouch is at a height of at least 0.5 inches above the base of the airbag.

3. The airbag according to claim 1, wherein the upstanding wall comprises a front wall and a rear wall bonded at their opposite side edges.

4. The airbag according to claim 1, wherein each inflatable tube of the plurality of inflatable tubes having an opening for receiving air under pressure, the opening configured with a one-way valve.

5. The airbag according to claim 1, wherein the web comprises a plurality of inflatable tubes.

6. A packaging sheet that can be folded to form a bag, the packaging sheet comprises:

an elongated sheet having a proximal end and a distal end, wherein the elongated sheet is configured to be folded to form a bag such as the proximal end juxtaposes the distal end forming an opening of the bag and the elongated sheet having a series of inflatable tubes arranged side by side and in rows; and a web having two opposite edges and a body that extends between the two opposite edges, an edge of the two opposite edges bonded to a periphery of the elongated sheet at the proximal end, another edge of the two opposite edges is free, a length of the web between the two opposite edges is less than a length of the elongated sheet between the proximal end and the distal end, a difference between the length of the elongated sheet and the length of the web is about 1 inch.

7. The packaging sheet according to claim 6, wherein each inflatable tube of the series of inflatable tubes having an opening to receive air under pressure, wherein each opening is configured with a one-way valve.

8. The packaging sheet according to claim 7, wherein the web has a plurality of inflatable tubes.

9. A bag comprises:

an inflatable liner having a series of inflatable tubes arranged side-by-side, the inflatable liner having a front edge, a rear edge, a left edge, and a right edge, a first length is a length of the inflatable liner between the front edge and the rear edge of the inflatable liner; and a web having a front edge, a rear edge, a left edge, and a right edge, a second length is a length of the web between the front edge and the rear edge of the web, the second length is at least one inch less than the first length, wherein the front edges and the rear edges of the inflatable liner and the web are bonded, the web is folded such as the front edge of the web juxtaposes the rear edge of the web, half section of the left edge juxtaposes another half section of the left edge of the web, half section of the right edge juxtaposes another half section of the right edge of the web, wherein the left edge of the web is bonded such as the half section of the left edge is bonded to another half section of the left edge forming the bag having two adjacent sides open and configured to envelop a corner of an object, the front edge of the web is not bonded to the rear edge of the web, and the half section of the right edge of the web is not bonded to the another half section of the right edge of the web.

* * * * *